US009573071B2

(12) United States Patent
Yu et al.

(10) Patent No.: US 9,573,071 B2
(45) Date of Patent: Feb. 21, 2017

(54) TOY RACETRACK HAVING COLLAPSIBLE LOOP PORTION

(71) Applicant: Mattel, Inc., El Segundo, CA (US)

(72) Inventors: Glenn Yu, Alhambra, CA (US); Douglas E. Bashaw, Burbank, CA (US); Paul W. Schmid, Ojai, CA (US); Michael W. Nuttall, South Pasadena, CA (US)

(73) Assignee: Mattel, Inc., El Segundo, CA (US)

( * ) Notice: Subject to any disclaimer, the term of this patent is extended or adjusted under 35 U.S.C. 154(b) by 198 days.

(21) Appl. No.: 14/477,091

(22) Filed: Sep. 4, 2014

(65) Prior Publication Data

US 2015/0060560 A1 Mar. 5, 2015

Related U.S. Application Data

(60) Provisional application No. 61/873,411, filed on Sep. 4, 2013.

(51) Int. Cl.
*A63H 18/02* (2006.01)

(52) U.S. Cl.
CPC ..... *A63H 18/021* (2013.01); *A63H 18/028* (2013.01)

(58) Field of Classification Search
CPC .... A63H 18/02; A63H 18/028; A63H 18/021; A63H 18/025; A63H 18/06; A63H 18/16; A63H 18/00; A63H 18/023; A63H 18/04; A63H 18/08; A63H 23/005; A63H 17/008; A63F 7/3622
See application file for complete search history.

(56) References Cited

U.S. PATENT DOCUMENTS

| | | | |
|---|---|---|---|
| 2,068,403 | A | 1/1937 | Ekstrom |
| 2,655,116 | A | 10/1953 | Gowland |
| 3,735,923 | A | 5/1973 | Brigham et al. |
| 3,750,945 | A | 8/1973 | Warr |
| 3,762,095 | A | 10/1973 | Merino et al. |
| 3,780,235 | A | 12/1973 | Deyerl et al. |
| 3,841,223 | A | 10/1974 | Bertin |
| 3,860,237 | A | 1/1975 | Cooper et al. |
| 3,958,361 | A | 5/1976 | Cooper et al. |

(Continued)

FOREIGN PATENT DOCUMENTS

DE 828 516 * 1/1952

*Primary Examiner* — Mark Le
(74) *Attorney, Agent, or Firm* — Sheppard, Mullin, Richter & Hampton LLP

(57) ABSTRACT

A toy racetrack including a partial loop section is configured to maintain a partial loop configuration when maintained in an unloaded, freestanding configuration, and to collapse when in a loaded state in which a toy vehicle passes over such partial loop section. When a force is applied to the upper section of the pathway from a traversing toy vehicle, the added force shifts the center of gravity past the balancing point that maintains the partial loop section in its freestanding configuration, and the partial loop section collapses. A spring-loaded head may be provided at the end of the upper portion of the partial loop section, and may be configured to spring away from the partial loop section when contacted by a toy vehicle. A wind-up motor may be provided that drives a diverter in the base of the partial loop section, which may direct a toy vehicle through the partial loop section or onto an alternative racetrack path.

18 Claims, 16 Drawing Sheets

(56) References Cited

U.S. PATENT DOCUMENTS

| | | | | |
|---|---|---|---|---|
| 4,095,743 | A | 6/1978 | Birdsall | |
| 4,151,679 | A | 5/1979 | Tanaka | |
| 4,221,076 | A | 9/1980 | Ozawa | |
| RE30,454 | E | 12/1980 | Birdsall | |
| 4,241,875 | A | 12/1980 | Vandenbrink | |
| 4,251,949 | A | 2/1981 | Buck et al. | |
| 4,254,907 | A * | 3/1981 | Pine | B60B 39/12 238/10 R |
| 4,394,961 | A | 7/1983 | Muller | |
| 4,425,735 | A | 1/1984 | Kulesza et al. | |
| 4,449,665 | A * | 5/1984 | Goldfarb | A63H 18/02 238/10 F |
| 4,496,100 | A | 1/1985 | Schwager | |
| 4,504,012 | A | 3/1985 | Fetty et al. | |
| 4,540,119 | A | 9/1985 | Neuhierl | |
| 4,544,094 | A | 10/1985 | Scholey | |
| 4,564,197 | A | 1/1986 | Lambert et al. | |
| 4,575,350 | A * | 3/1986 | Hippely | A63F 7/3622 238/10 A |
| 4,767,053 | A | 8/1988 | Cook et al. | |
| 4,941,610 | A | 7/1990 | Frauca | |
| 5,323,962 | A | 6/1994 | Jassby et al. | |
| 5,377,595 | A | 1/1995 | Liu | |
| 5,678,489 | A | 10/1997 | Wang | |
| 6,089,951 | A | 7/2000 | Ostendorff | |
| 6,164,555 | A | 12/2000 | Fulton et al. | |
| 6,176,760 | B1 | 1/2001 | Ngai | |
| 6,358,112 | B1 | 3/2002 | Lambert et al. | |
| 6,382,519 | B1 | 5/2002 | Choi | |
| 6,446,981 | B1 * | 9/2002 | Wise | B62B 3/007 280/30 |
| 6,631,850 | B1 | 10/2003 | Wa | |
| 6,776,685 | B2 | 8/2004 | Reisher et al. | |
| 6,783,419 | B1 | 8/2004 | Paukert et al. | |
| 6,913,508 | B2 * | 7/2005 | Hornsby | A63H 17/28 446/438 |
| 7,051,948 | B2 | 5/2006 | Wa | |
| 7,600,757 | B1 | 10/2009 | Matilla et al. | |
| 7,628,674 | B2 | 12/2009 | Nuttall et al. | |
| 7,770,811 | B2 | 8/2010 | Belding | |
| 7,882,788 | B2 | 2/2011 | Sorenson | |
| 7,892,068 | B2 | 2/2011 | Nuttall et al. | |
| 8,061,627 | B2 | 11/2011 | Norman et al. | |
| 8,376,804 | B2 | 2/2013 | Willett et al. | |
| 2005/0287917 | A1 | 12/2005 | Sheltman et al. | |
| 2005/0287919 | A1 | 12/2005 | Sheltman et al. | |
| 2006/0128256 | A1 * | 6/2006 | Collins | A63H 18/02 446/73 |
| 2007/0037478 | A1 | 2/2007 | Zane | |
| 2011/0021110 | A1 | 1/2011 | Hippely et al. | |
| 2011/0294396 | A1 | 12/2011 | O'Connor et al. | |
| 2012/0052766 | A1 | 3/2012 | Payne | |
| 2012/0164914 | A1 | 6/2012 | O'Connor et al. | |
| 2012/0171925 | A1 | 7/2012 | Damarin | |
| 2012/0322342 | A1 | 12/2012 | De La Torre | |

* cited by examiner

TOY RACETRACK HAVING COLLAPSIBLE LOOP PORTION

CROSS-REFERENCE TO RELATED APPLICATIONS

This application is based upon and claims priority from U.S. Provisional Patent Application Ser. No. 61/873,411 entitled "Toy Racetrack Having Collapsible Loop Portion," filed with the United States Patent and Trademark Office on Sep. 4, 2013 by the inventors herein, the specification of which is incorporated herein by reference in its entirety.

FIELD OF THE INVENTION

The present invention relates to toy racetracks, and more particularly, to a racetrack for toy vehicles having a track portion that reconfigures the toy vehicle path as a result of a toy vehicle passing over such track portion.

BACKGROUND

Toy racetracks are popular among children of varied ages, and a variety of track configurations have previously been provided that include various features, such as traps, loops, stunts, and the like to add to the excitement a child experiences while playing with the toy. For instance, toy racetracks have been provided having varied loops and turns that may form complex pathways for the toy vehicle, as well as varied obstacles or stunt devices that the toy vehicle must successfully traverse in order to continue through the racetrack path.

For example, U.S. Pat. No. 4,575,350 to Hippely et al. discloses a toy racetrack having a snake head at the end of the track, the snake head including a flexible, rolled tongue. As a toy vehicle impacts the rolled tongue, it will unroll the tongue and continue along its path only if it has enough energy at that time to fully unroll the tongue.

U.S. Pat. No. 6,358,112 to Lambert et al. discloses a toy racetrack having a stunt loop portion with a movable creature head on the inner portion of the loop, which movable creature head will move from a toy vehicle non-capture position to a toy vehicle capture position based upon the amount of energy that is transferred to the loop from a toy vehicle as it traverses the loop.

U.S. Pat. No. 7,628,674 to Nuttall et al. discloses a toy racetrack having moveable track segments that vary position through an indexing mechanism that operates in response to a toy vehicle travelling through the racetrack.

U.S. Patent Publication No. 2005/0287919 of Sheltman et al. discloses a toy racetrack having a swinging traveler that captures a toy vehicle as it travels through the racetrack, and rotates about a support until it aligns with a subsequent section of track, after which it releases the toy vehicle to continue its travel through the racetrack.

U.S. Patent Publication No. 2012/0164914 of O'connor et al. discloses a toy racetrack having a variety of track segments that change position as a toy vehicle traverses those segments.

U.S. Patent Publication No. 2012/0322342 of De La Torre discloses a toy racetrack having a swinging and spinning toy vehicle support that intercepts a toy vehicle as it travels through the racetrack, and thereafter swings and spins to a new position that releases the toy vehicle onto a subsequent track section.

While the foregoing configurations do provide varied obstacle and stunt features, there remains an ongoing need to provide toy racetrack features capable of maintaining the interest of a child and increasing the excitement and amusement they experience when playing with a toy racetrack. It would therefore be advantageous to provide a toy racetrack that further enhances the excitement and amusement offered to a child as they engage in such play.

SUMMARY OF THE INVENTION

In accordance with certain aspects of an embodiment of the invention, disclosed is a toy racetrack that includes a partial loop section configured to maintain a partial loop configuration when maintained in an unloaded state (i.e., when freestanding in a partial loop configuration without a toy vehicle passing over the partial loop section), and that collapses when in a loaded state in which a toy vehicle passes over such partial loop section. The partial loop section comprises a series of hingedly connected, arcuate track segments. Each arcuate track segment stacks on top of the previous track segment to form a pathway for a toy vehicle, such as a die cast car, which pathway curves upwardly. A hinged stand on the opposite surface of the segment from the pathway may be configured to prop up the vertically arcuate track segment pathway. A sufficient number of arcuate track segments are provided so that the pathway preferably begins to curve back over itself. The partial loop portion is preferably configured so that the center of gravity of the series of segments lies approximately over the location at which the stand props up the segments, thus allowing the vertical segments to "balance" and maintain a free-standing, partial loop configuration. In this configuration, when a force is applied to the upper section of the pathway, such as a force resulting from a vehicle travelling along and up to the upper section of the pathway, the added force shifts the center of gravity past the balancing point, and the partial loop section collapses.

In accordance with further aspects of an embodiment of the invention, a preferably ornamental head, such as a faux snake head, may be provided at the terminal end of the upper portion of the partial loop section. The head may be spring-loaded with a trigger, which trigger may optionally be configured as a tongue for the creature whose head is represented, with the tongue aligning with the end of the vehicle path. The spring is loaded upon connection with the terminal arcuate track segment in the partial loop section, and contact with the trigger (such as by a vehicle travelling along the pathway coming into contact with the trigger) releases the spring and causes the head to spring away from the "body" of the creature (such "body" being represented by the remainder of the partial loop section). In certain embodiments, a wind-up motor may drive a diverter in the base of the partial loop section, which diverter may be disguised as a "tail" of the creature, and may move from a first position that will direct a toy vehicle through the partial loop section, to a second position that will direct a toy vehicle away from the partial loop section and onto an alternative racetrack path.

BRIEF DESCRIPTION OF THE DRAWINGS

The numerous advantages of the present invention may be better understood by those skilled in the art by reference to the accompanying drawings in which.

DETAILED DESCRIPTION OF THE PREFERRED EMBODIMENTS

The following description is of a particular embodiment of the invention, set out to enable one to practice an implementation of the invention, and is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1A:
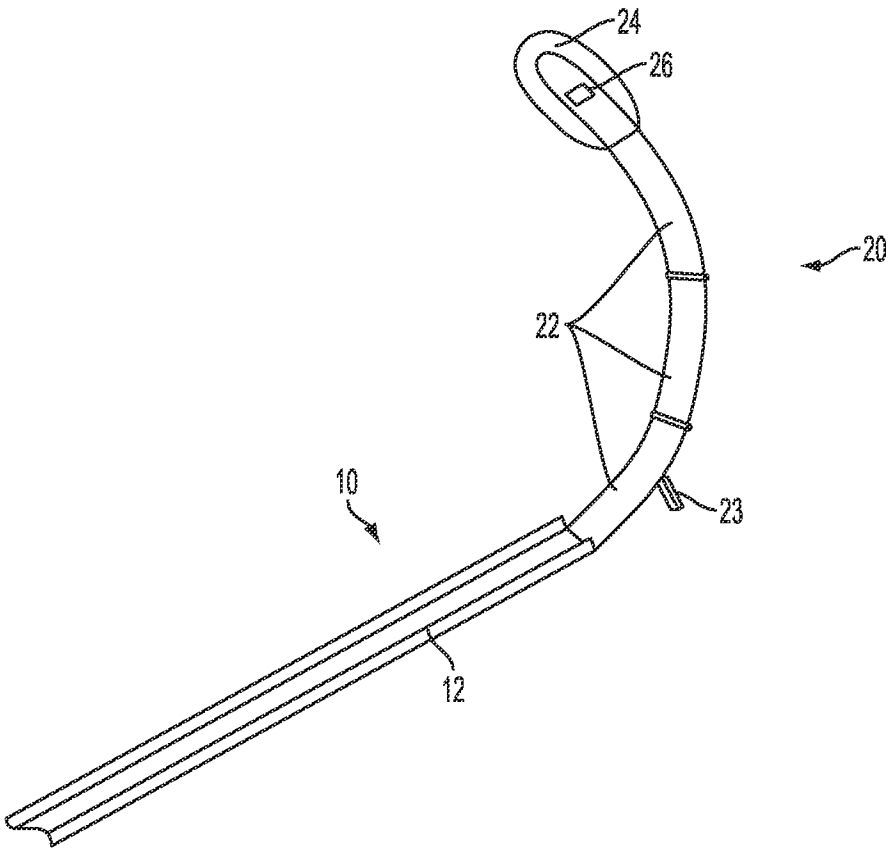
FIG. 1*a* is a side perspective view of a toy racetrack in accordance with certain aspects of an embodiment of the invention.

FIG. 1*a* provides a perspective view of a toy racetrack (shown generally at 10) in accordance with certain aspects of an embodiment of the invention. As shown in FIG. 1, toy racetrack 10 includes a section of track 12, such as an extruded plastic track configured for use with die cast cars, and a collapsible partial loop section 20 attached to the end of track 12. Collapsible partial loop section 20 is comprised of multiple arcuate track sections 22 that are hinged to one another (and freely pivoting with respect to one another) along their leading edges. The arcuate track sections 22 are each configured to stack on top of the previous track segment to form an upwardly curving pathway for a toy vehicle. The arcuate track sections 22 are positionable with respect to one another to form a partial loop that extends upward from track 12 and that ends at the top region of the partial loop, such that the partial loop begins to curve back over itself. When the arcuate track sections are so positioned to form the partial loop, the center of gravity of the resulting partial loop is positioned so as to allow the multiple arcuate track segments 22 to balance and maintain the partial loop configuration. A stand 23 may be positioned on the back side of partial loop section 20, which stand 23 may be positioned to help prop up the arcuate track sections 22 into the partial loop, but which is configured to collapse under the arcuate track segments when the partial loop begins to collapse. Thus, when a force is applied to the upper section of the partial loop, such as a force resulting from a toy vehicle travelling through toy racetrack 10 and up to the upper section of the partial loop, the added force shifts the center of gravity of the partial loop past the balancing point, in turn causing the arcuate track sections 22 to fall and collapsing the partial loop.

In some embodiments, a launching member 24 is provided at the free end of the partial loop section, with at least a portion of the launching member 24, such as an underside of the launching member 24, being in line with the path of travel of a toy vehicle as it traverses and ultimately exits the partial loop section 20. Launching member 24 may include a trigger 26 extending into the pathway of the toy vehicle, and may be configured so that in response to a toy vehicle striking trigger 26, launching member 24 may be dislodged from partial loop section 20. To aid in the release and launch of launching member 24 from the partial loop section 20, launching member 24 may be spring biased, with activation of trigger 26 causing an internal spring (not shown) to launch lunching member 24 away from the free end of partial loop section 20, just as partial loop section 20 is collapsing.

Figure 1B:
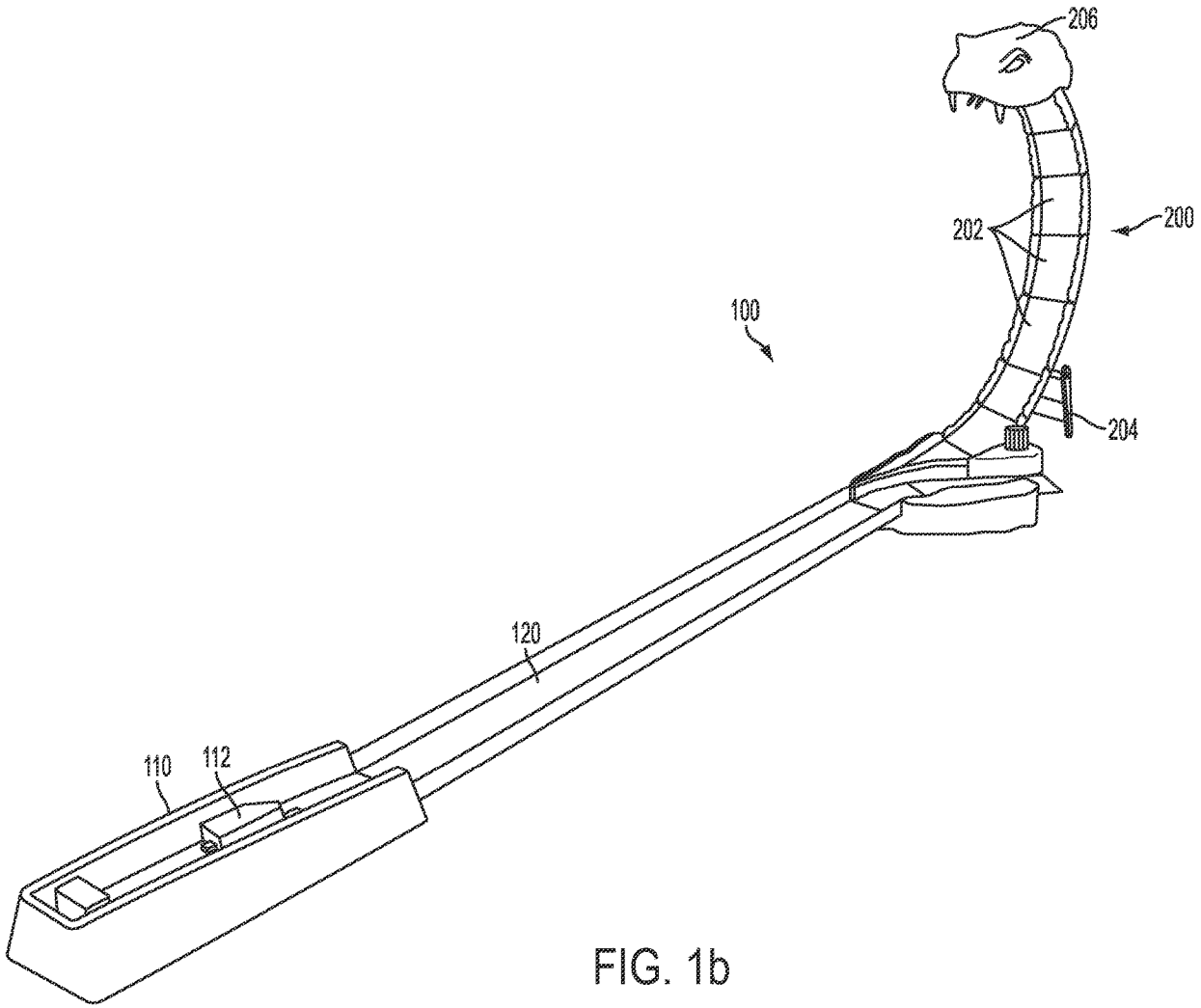
FIG. 1*b* is a side perspective view of a toy racetrack in accordance with further aspects of an embodiment of the invention.

FIG. 1*b* provides a perspective view of a toy racetrack (shown generally at 100) in accordance with further aspects of an embodiment of the invention. As shown in FIG. 1*b*, toy racetrack 100 includes a toy vehicle (such as a die cast metal car) launcher assembly 110, a section of extruded plastic track 120 attached to launcher assembly 110 so as to receive and guide a toy vehicle as it is launched from launcher assembly 110, and a collapsible partial loop section 200 attached to the end of plastic track 120 opposite launcher assembly 110. Launcher assembly 110 includes a spring-loaded launch member 112 configured to launch a toy vehicle onto track 120 when triggered by a user, thus directing the toy vehicle across track 120 and towards collapsible partial loop section 200. A suitable launcher assembly 110 for use with the toy racetrack 100 is described in detail in co-owned U.S. Pat. No. 8,298,035, the specification of which is incorporated herein by reference in its entirety.

Collapsible partial loop section 200 is comprised of multiple arcuate track sections 202 that are hinged to one another (and freely pivoting with respect to one another) along their leading edges, and may be positioned with respect to one another to form a partial loop that extends upward from the surface on which launcher 110 and track 120 are situated, and that ends at the top region of the partial loop, such that the partial loop begins to curve back over itself. A stand 204 may be positioned on the back side of partial loop section 200, which stand 204 may be positioned to help prop up the arcuate track sections 202 into the partial loop. When the arcuate track sections are so positioned to form the partial loop, the center of gravity of the resulting partial loop preferably lies approximately over the stand 204, allowing the multiple arcuate track segments 202 to balance and maintain the partial loop configuration. However, when a force is applied to the upper section of the partial loop, such as from a toy vehicle travelling through toy racetrack 100 and up to the upper section of the partial loop, the added force shifts the center of gravity of the partial loop past the balancing point, in turn causing the arcuate track sections 202 to fall and collapsing the partial loop.

In certain embodiments of the invention, an ornamental head member 206 (shown as the head of a snake in FIG. 1, with the multiple arcuate track sections 202 resembling the body of the snake) may be attached to the free end of collapsible partial loop section 200, and may be configured to disconnect from the rest of collapsible partial loop section 200 when impacted by a toy vehicle travelling through the partial loop. Moreover, ornamental head member 206 may be spring-loaded, having a trigger that when impacted by a toy vehicle releases the spring and causes the head member 206 to spring away from partial loop section 202.

Figure 2:
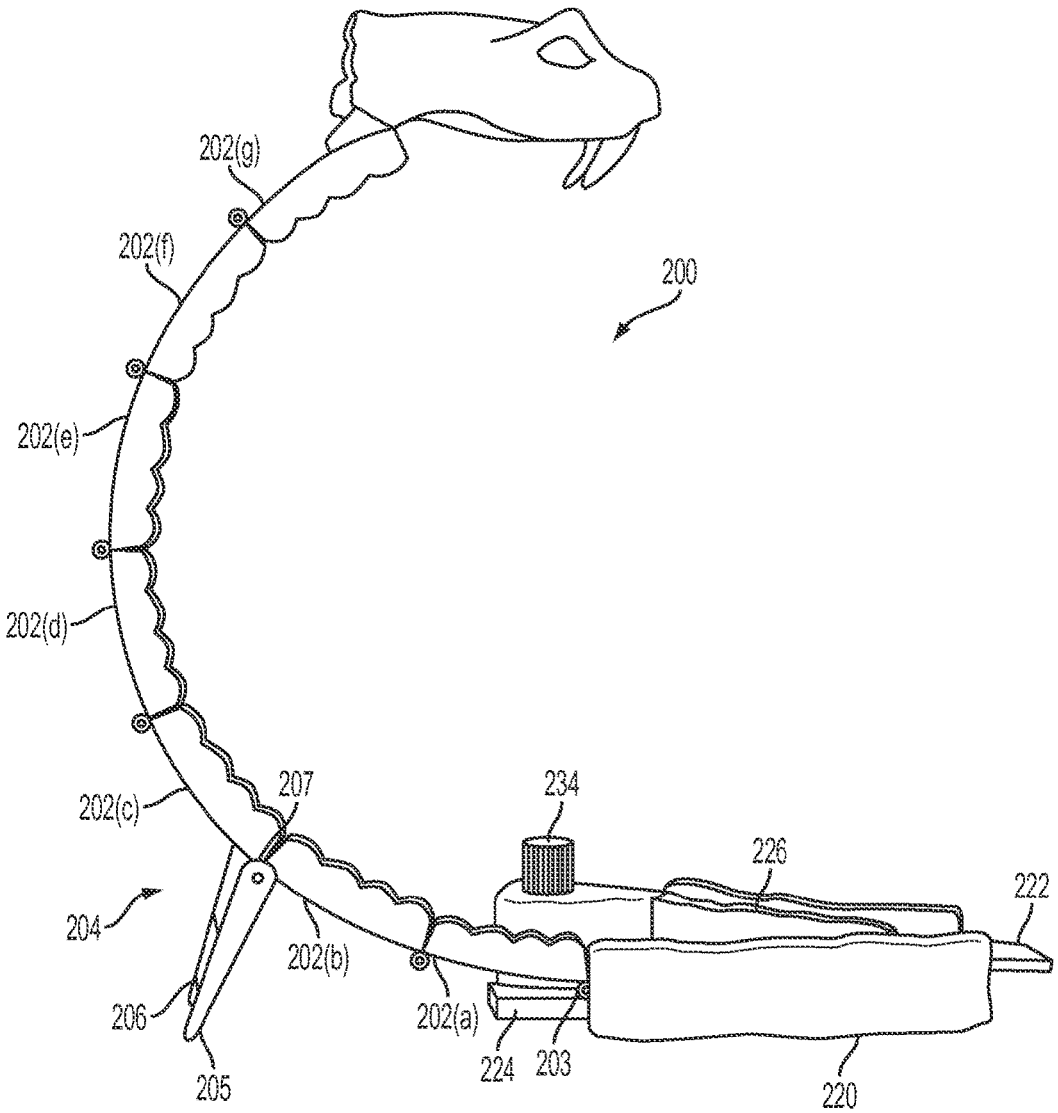
FIG. 2 is a side view of a partial loop section of the toy racetrack of FIG. 1*b*.
Figure 3:
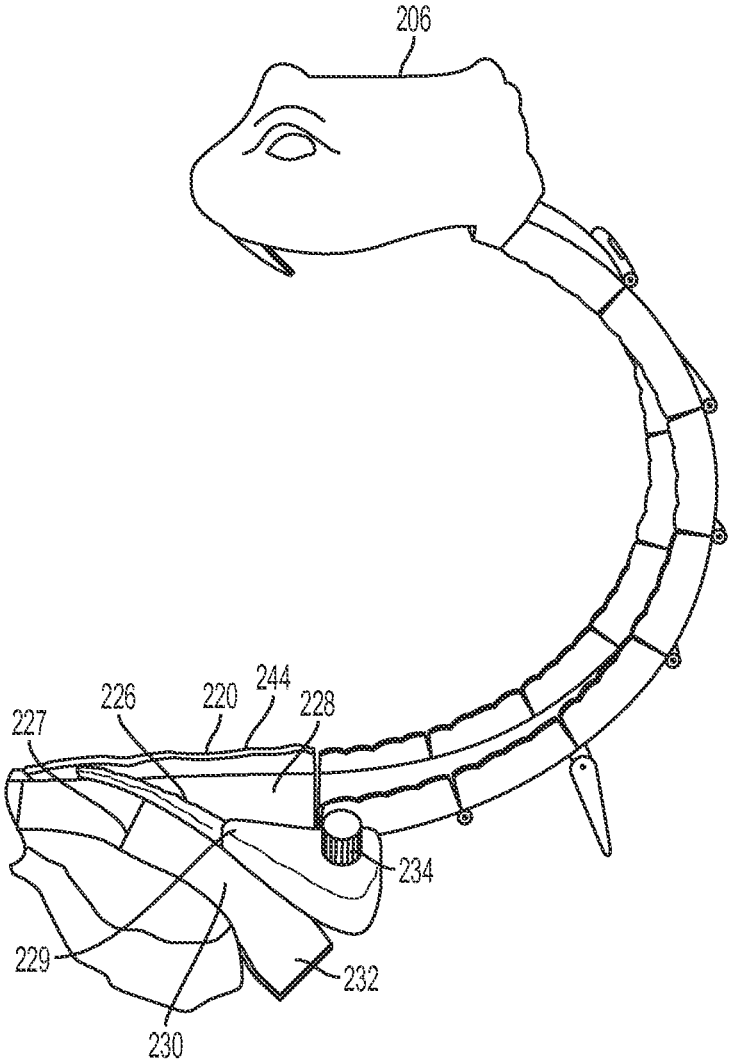
FIG. 3 is a side, top perspective view of the partial loop section of FIG. 2.
Figure 4:
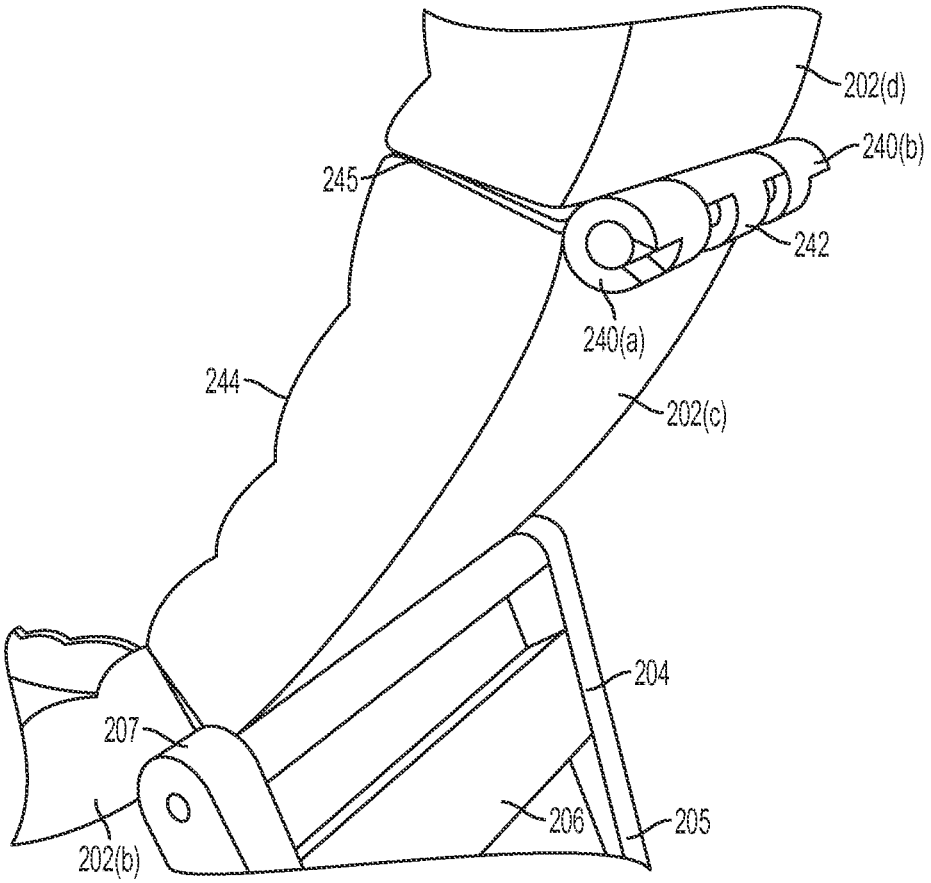
FIG. 4 is a side, rear perspective view of an arcuate track segment for use in the partial loop section of FIG. 2.

With reference to the exemplary embodiment shown in FIGS. 2-4, collapsible partial loop section 200 extends upward from a base 220 to which track sections 202 connect. Base 220 may include a first connection tab 222 configured to receive plastic track 120, and a second connection tab 224 configured to receive additional sections of plastic track 120, the purpose of which will be further detailed below. A diverter 226 is hingedly mounted at pivot connection 229 (FIG. 3) to base 200 and is moveable so as to provide a first toy vehicle path 228, which directs a toy vehicle coming from launcher assembly 110 and across plastic track 120 into the partial loop section 200, and a second toy vehicle path 230, which directs such a toy vehicle away from partial loop section 200 and to additional sections of plastic track (not shown). Such additional sections of plastic track may be attached to a further track connection tab 232 situated at the end of toy vehicle path 230 on base 220. A guide pin (not shown) may extend downward from diverter 226 and may ride within a guide path opening 227 cut across toy vehicle paths 228 and 230. Diverter 226 may be manually moveable between the two positions to establish the toy vehicle path with which the user wishes to play, or alternatively may be automated to move between the two positions. For instance, a wind-up motor 234 may be provided that, when wound by a user, causes diverter 226 to move between the two positions, thus creating a challenge for the user to time the launch of their toy vehicle so that it engages the desired toy vehicle path 228 or 230 when such toy vehicle reaches base 220.

In order to assist in guiding a toy vehicle as it travels through path 228, the side of diverter 226 that faces toy vehicle path 228 preferably forms a generally straight line that extends parallel to a sidewall 244 on the opposite side of path 228. Likewise, in order to assist in guiding a toy vehicle as it travels through path 230, the side of diverter that faces toy vehicle path 230 preferably forms a curved wall to smoothly turn the toy vehicle towards path 230. Moreover, diverter 226 may be provided in the shape of a tapering tail of an animal depicted by ornamental head member 206, such as (in the exemplary case shown in the Figures) the tail of a snake.

Those of ordinary skill in the art will recognize that more or fewer intermediate arcuate track sections 202 than what are shown in the Figures may be provided without departing from the spirit and scope of the invention.

As mentioned briefly above, arcuate track sections 202 may be positioned to form partial loop section 200, as they are hingedly connected to one another along their leading edges. A first such arcuate track section 202(*a*) is hingedly mounted to base 220 at a hinge pin 203, and may be positioned above second connection tab 224 with sufficient clearance so as to allow insertion of a section of plastic track onto connection tab 224 between the bottom of arcuate track section 202(*a*) and the play surface on which toy racetrack 100 is positioned. Additional arcuate track sections 202(*b*)-202(*g*) are provided, each being hinged to its adjacent track section(s), such that each arcuate track section may pivot with respect to its adjacent track section(s). To foster such pivoting movement between adjacent track sections, and with particular reference to FIG. 4, each arcuate track section 202 has at a first end a first segment of a hinge joint, and at a second end a second segment of a hinge joint, which first and section sections mate with one another and receive a hinge pin therethrough to provide a hinged joint. For example, arcuate track section 202(*c*) shown in FIG. 4 has first hinge segment 240(*a*) and 240(*b*) affixed to the underside of track section 202(*c*) at its first end (such first end being the end of the respective track segment 202 that is furthest from launcher assembly 110), and adjacent arcuate track section 202(*d*) has second hinge segment 242 affixed to the underside of track section 202(*d*) at its second end (such second end being the end of the respective track segment 202 that is closest to launcher assembly 110). As shown in the close-up view of FIG. 4, each arcuate track segment 202 has side walls 244 extending upward from the track surface of each track segment 202 on which a toy vehicle rides, which side walls 244 help to guide the toy vehicle through partial loop section 200. An upper edge 245 of adjacent side walls 244 of adjacent arcuate track segments 202 ultimately come in contact with one another at their respective wall edges as adjacent arcuate track segments 202 are pivoted toward one another, thus limiting the extent to which adjacent track segments 202 may pivot toward one another. Moreover, as the track segments 202 are manipulated to form partial loop section 200, the arcuate track segments 202 stack atop one another along their facing wall edges, with a terminal, upper most arcuate track segment 202(*g*) pointing back toward launcher assembly 110, such that the partial loop section begins to curve back over itself. In order to allow adjacent track segments to pivot toward one another, the edges of side walls 244 preferably are oriented at less than 90° to the track surface at the end of the track segment, thus allowing adjacent walls to come into contact after two adjacent track segments are pivoted toward one another.

Figure 5:
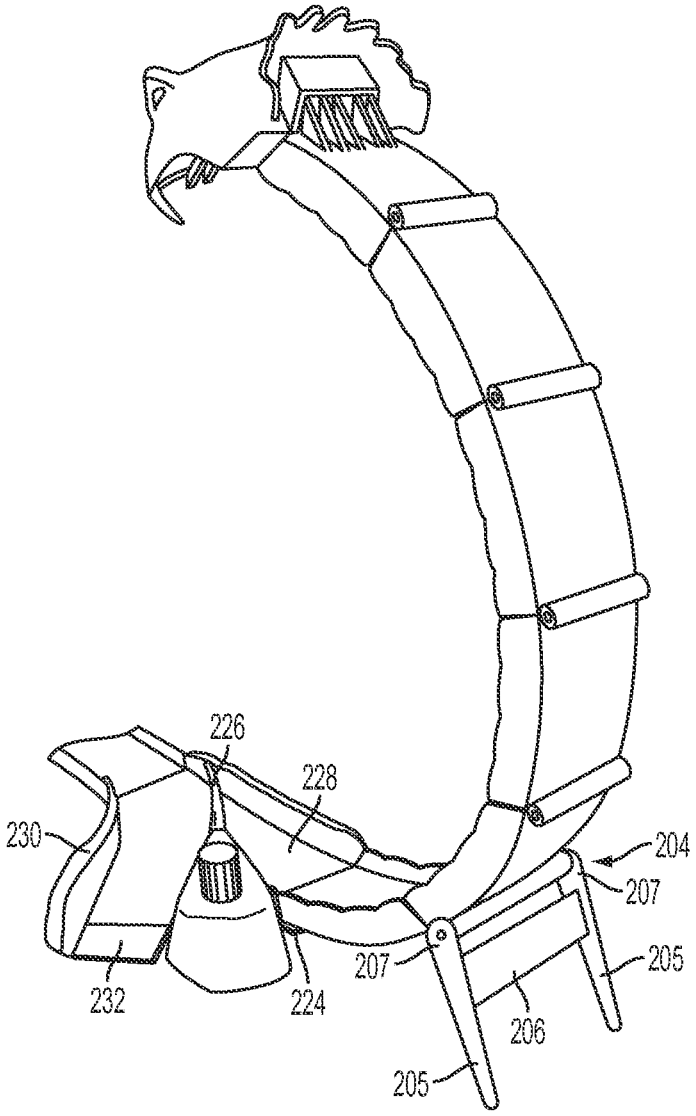
FIG. 5 is a side, rear perspective view of the partial loop section of FIG. 2.

As shown in FIGS. 1-5, stand 204 is hingedly attached to the underside of partial loop section 200. With particular reference to FIGS. 2, 4, and 5, stand 204 may include legs 205 that extend away from the underside of partial loop section 200. A top portion 207 of each leg 205 has a hole extending therethrough, which hole receives a hinge pin that likewise extends through hinge segments 240 and 242 on the adjacent arcuate track segments 202 to which leg 204 is attached. A spacer bar 206 runs between legs 205, and is positioned a sufficient distance from the free ends of legs 205 (i.e., the ends opposite top portion 207) so that when leg 204 is positioned to prop up partial loop section 200, a sufficient clearance exists below horizontal spacer bar 206 so that an additional plastic track section may run beneath stand 204.

Figure 6:
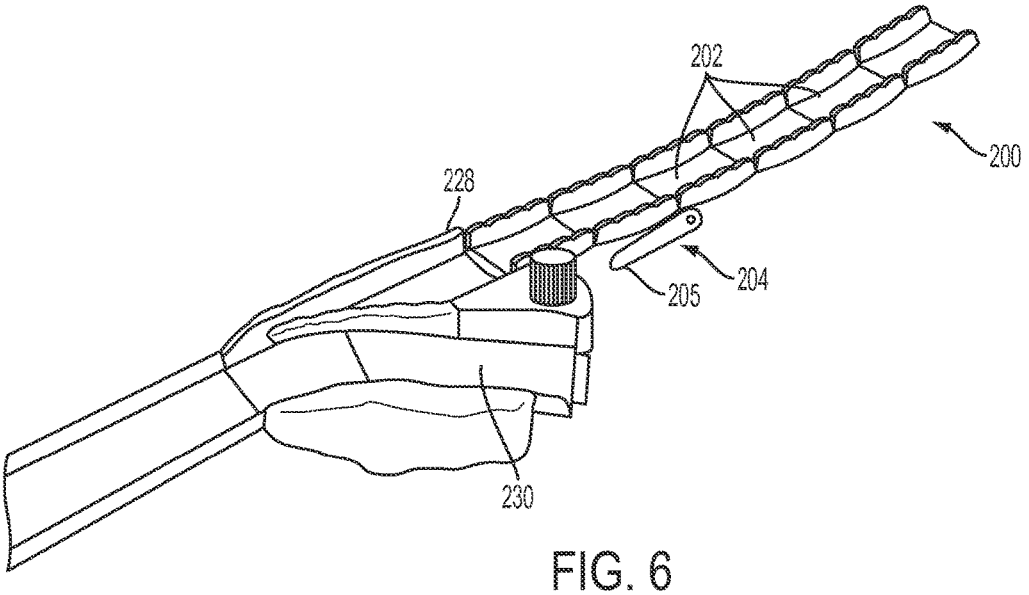
FIG. 6 is a front, top perspective view of the partial loop section of FIG. 2 in a collapsed condition.

Top portion 207 of stand 204 is preferably configured so as to limit the extent to which stand 204 may pivot with respect to partial loop section 200. More particularly, and with specific reference to FIG. 2, stand 204 may be positioned with legs 205 extending down from the underside of partial loop section 200 and away from base 220, but only to a limit position. Thus, as a toy vehicle initially enters into partial loop section 200, stand 204 will not collapse but instead will continue to assist in holding partial loop section 200 in its upright configuration. However, as the toy vehicle traverses partial loop section 200 and approaches the top end of partial loop section 200 so as to shift the center of gravity as discussed above, the partial loop section 200 collapses, and as it collapses causes stand 204 to fold under arcuate track segments 202 with the free ends of legs 205 moving towards base 220. As shown in FIG. 6, in such a collapsed condition, arcuate track segments 202 form a nearly horizontal track segment, such that toy vehicles travelling along the racetrack after such collapse and through first toy vehicle path 228 will continue on to any additional plastic track sections that have been connected to second connection tab 224. So that partial loop section 200 may achieve such nearly horizontal track segment configuration after its collapse, legs 205 of stand 204 are spaced apart from one another a sufficient distance such that the entire width of arcuate track segments 202 may sit between legs 205.

In order to best support partial loop section 200 in its partial loop configuration, stand 204 is preferably joined to the underside of partial loop section 200 at the hinge joint that is closest to 45 degrees from the plane that includes toy vehicle path 228.

Figure 7:
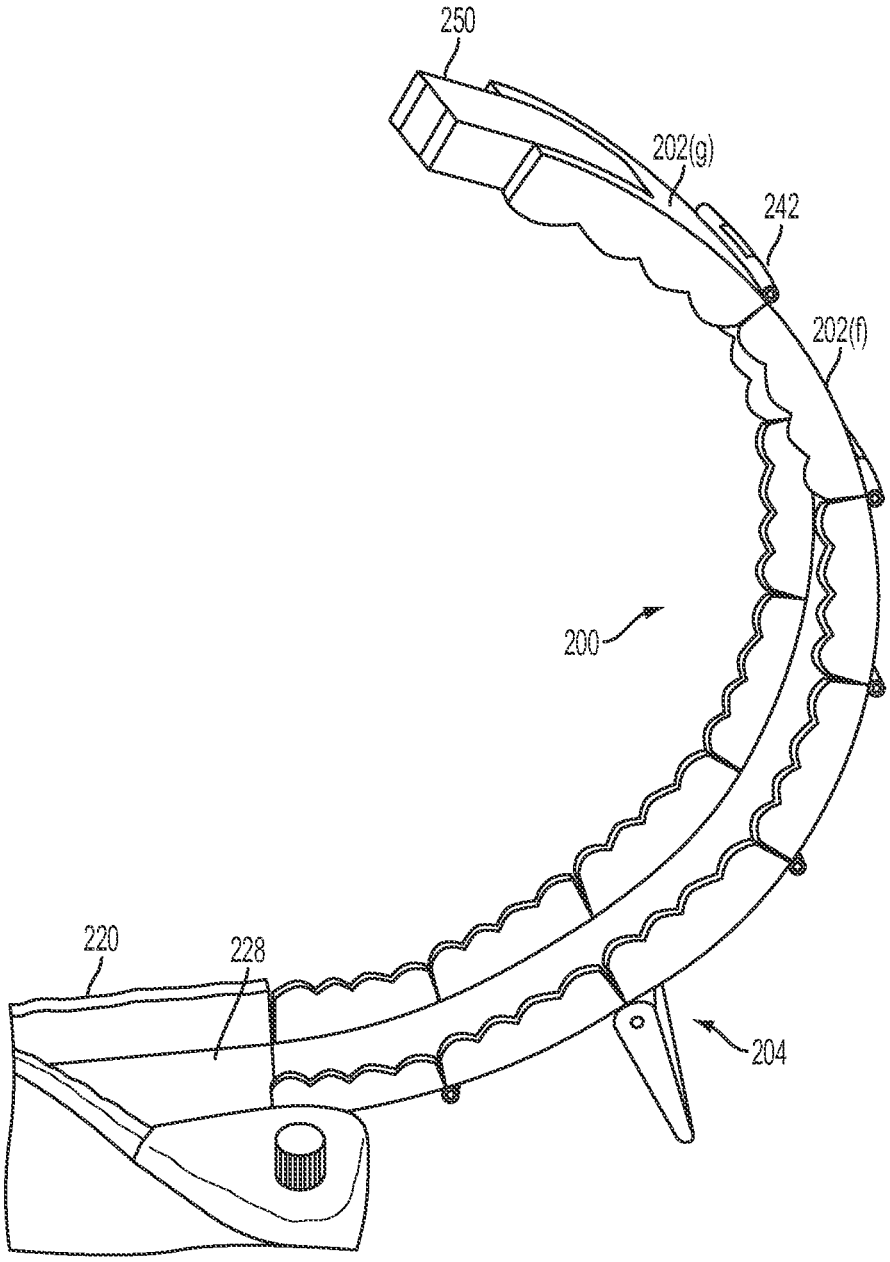
FIG. 7 is a side perspective view of a portion of the partial loop section of FIG. 2.

Next, and with reference to FIG. 7, a terminal, upper most arcuate track segment 202(*g*) is configured with a hinge segment for forming a hinged joint with the adjacent, preceding arcuate track segment 202(*f*) only at the second end of terminal upper most arcuate track segment 202(*g*), while the first end of such track segment 202(*g*) is configured for connection to ornamental head member 206. A head carrier 250 extends forward of the first end of upper most arcuate track segment 202(*g*) and away from the underside of such track segment 202(*g*). Thus, when all of arcuate track segments 202 are positioned so as to form partial loop 200, head carrier 250 extends outward from the top-most portion of partial loop 200 and back toward launch assembly 110. In this position, head member 206 may be inserted onto head carrier 250.

Figure 8:
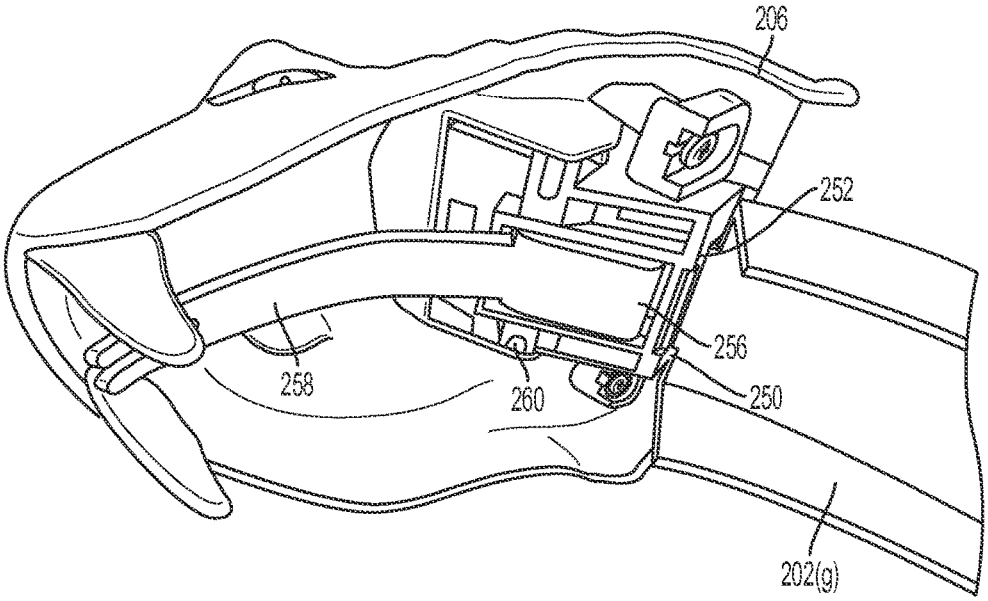
FIG. 8 is a bottom, side perspective view of the ornamental head of FIG. 7.
Figure 9:
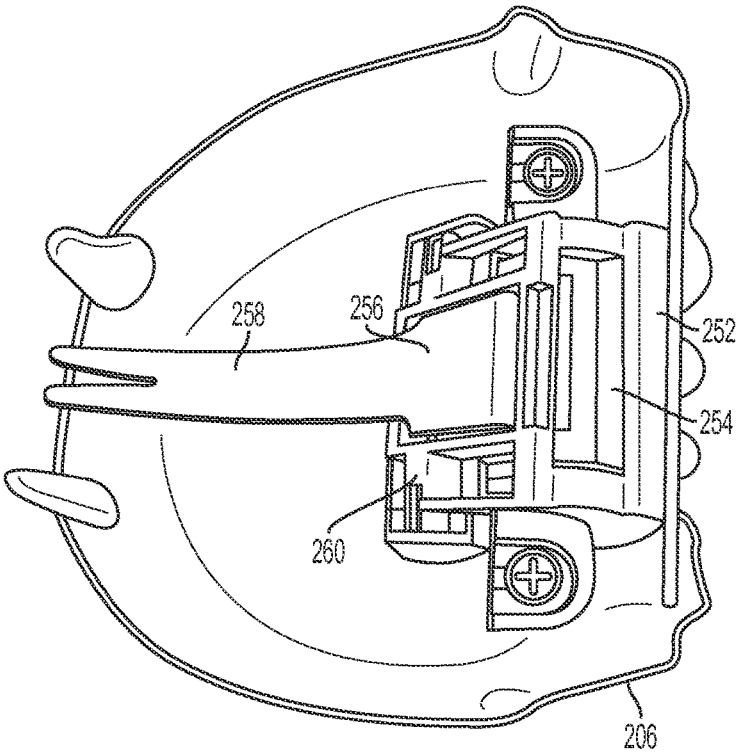
FIG. 9 is a bottom, rear perspective view of an ornamental head for use with the partial loop section of FIG. 2.
Figure 10:
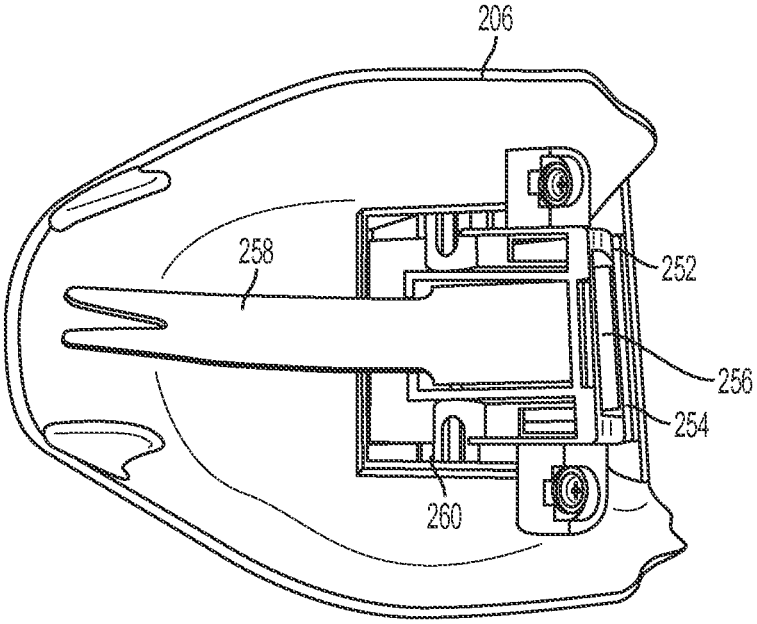
FIG. 10 is a bottom view of the ornamental head of FIG. 9.
Figure 11:
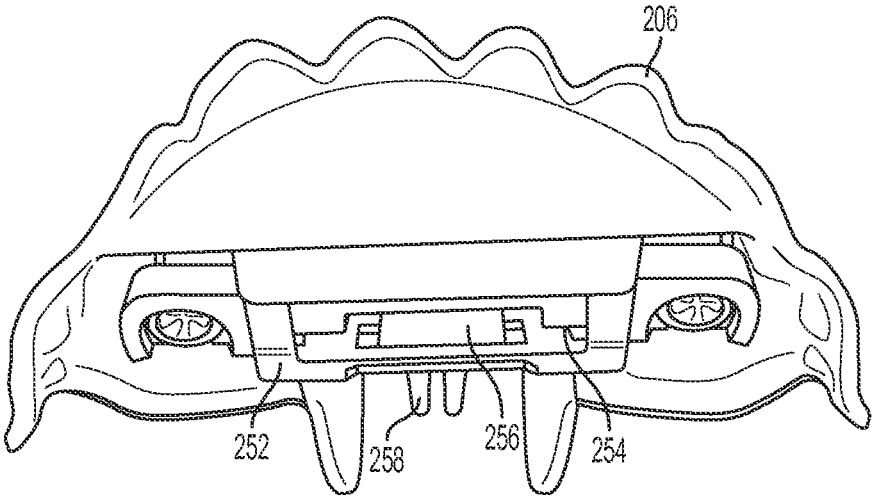
FIG. 11 is a rear view of the ornamental head of FIG. 9.
Figure 16:
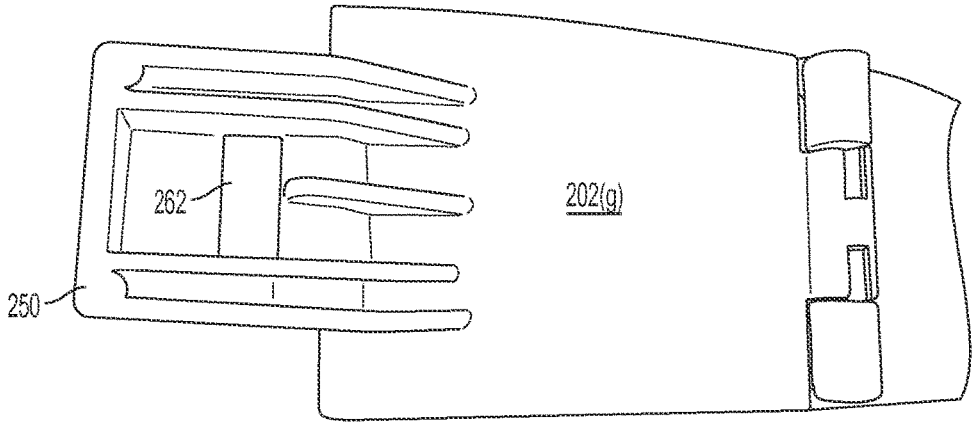
FIG. 16 is a top view of a head carrier at a terminal arcuate track segment of a partial loop section of a toy racetrack.
Figure 17:
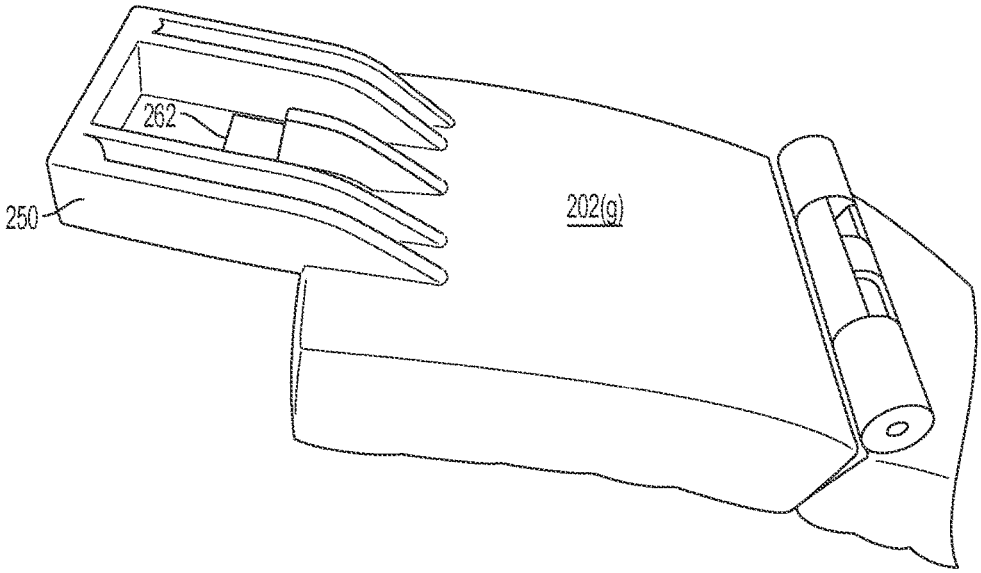
FIG. 17 is a side perspective view of the head carrier of FIG. 16.
Figure 18:
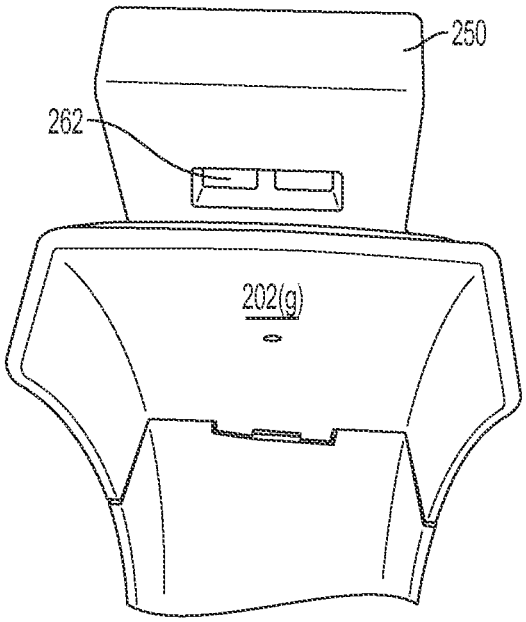
FIG. 18 is a front view of the head carrier of FIG. 16.

FIG. 8 is a bottom perspective view of head member 206 mounted on head carrier 250 of terminal arcuate track segment 202(*g*). FIG. 8 shows head member 206 in a "set" position, in which head carrier 250 has been inserted into a receiver 252 on the underside of head member 206. With reference to FIG. 8 and the rear perspective, bottom, and rear views of detached head member 206 shown in FIGS. 9, 10, and 11, respectively, receiver 252 holds a rearwardly spring-biased plate 254, which plate 254 may be pushed into the body of receiver 252 against the bias of an internal spring (not shown in FIGS. 8 and 9). Thus, when head member 206 is pushed onto head carrier 250, head carrier 250 pushes plate 254 into receiver 252 until a latch 256 engages an opening 262 in the bottom surface of head carrier 250 (as shown in FIGS. 16-18). Latch 256 is hingedly connected to the underside of receiver 252, and includes an extension 258 extending outward from a pivot hinge connection 260. Once spring biased plate 254 is pushed by head carrier 250 into receiver 252 a sufficient distance so that the opening 262 in head carrier 250 engages latch 256, subsequent movement of latch extension 258 towards head member 206 will pivot latch 256, causing latch 256 to disengage from head carrier 250, at which point the internal spring inside of receiver 252 will quickly push plate 254 against head carrier 250 outwards towards a stop position (such stop position being reflected in FIG. 9), in turn causing head member 206 to spring away from partial loop portion 200 of toy racetrack 100.

Figure 12:
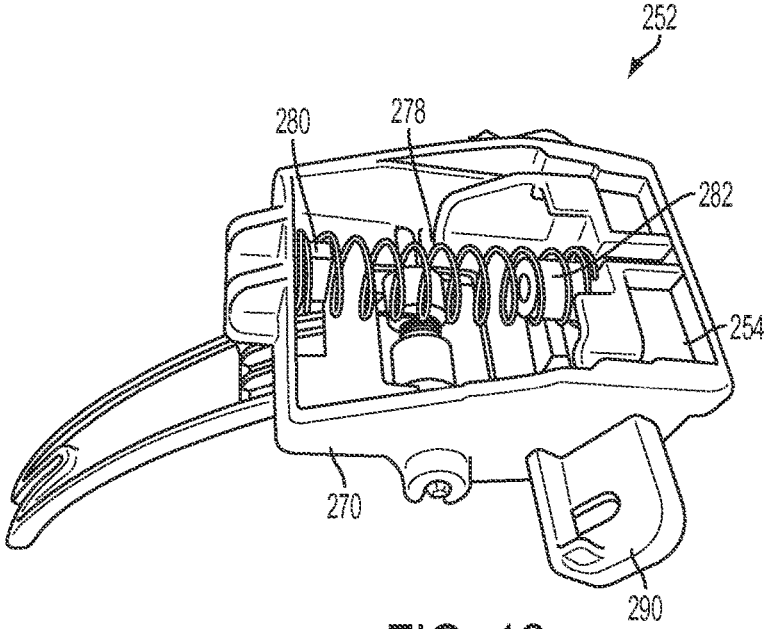
FIG. 12 is a perspective view of a head carrier receiver for use with the ornamental head of FIG. 9.
Figure 13:
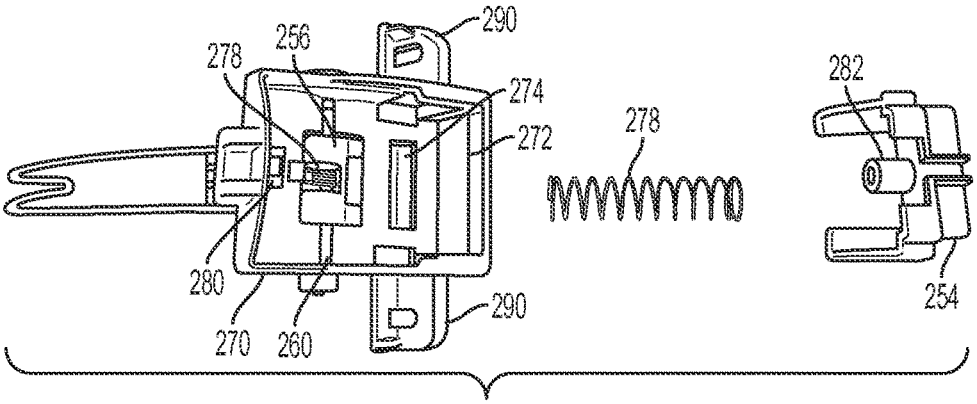
FIG. 13 is an exploded view of the head carrier receiver of FIG. 12.
Figure 14:
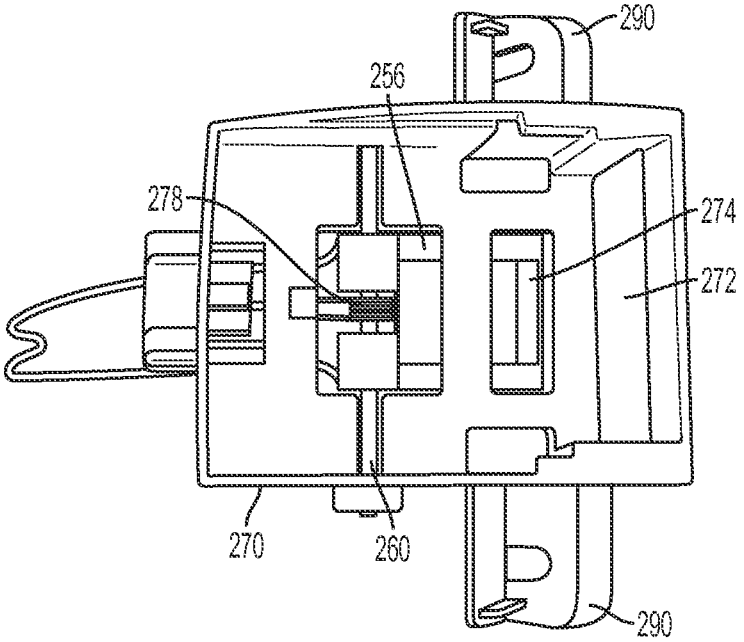
FIG. 14 is a top view of a receiver block housing.

FIG. 12 is a perspective view of receiver 252 shown removed from head member 206, and FIG. 13 is an exploded view of several components of receiver 252. As shown in FIGS. 12 and 13, receiver 252 includes a receiver block housing 270 which is mounted to the underside of head member 206, such that the underside of head member 206 forms a ceiling for receiver block housing 270 to form a closed assembly. A back end of receiver block housing 270 has an opening 272 sized to receive head carrier 250 and to allow relative sliding movement between head carrier 250 and receiver 252. As best shown in the top view of receiver block housing 270 shown in FIG. 14, latch 256 is pivotally mounted at pivot hinge connection 260 to the bottom side of receiver block housing 270. A back end of latch 256 includes an upwardly extending hook 274 which moves into and out of the interior of receiver block housing 270 through an opening 276 in the bottom surface of receiver block housing 270 as latch 256 pivots about pivot hinge connection 260. A spring member 279 biases hook 274 upward into receiver block housing 270, such that when head carrier 250 is inserted into receiver 252, hook 274 remains biased toward a position that holds receiver 252 on head carrier 250 until latch 256 is pivoted.

Figure 15:
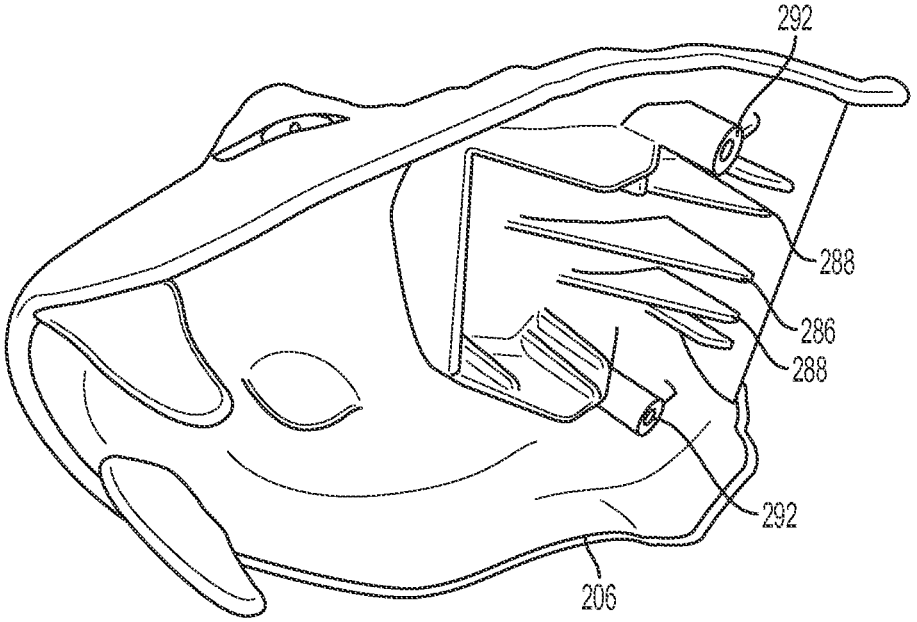
FIG. 15 is a bottom perspective view of a portion of the ornamental head of FIG. 9.

With continued reference to FIGS. 12 and 13, spring biased plate 254 is positioned within receiver block housing 270 and is mounted for sliding movement within receiver block housing 270. A spring member 278, such as a coil spring, biases plate 254 toward the back end of receiver 252, with the back wall of receiver 252 forming a stop against further movement of plate 254. Spring member 278 may be attached to a first spring receiving hub 280 on a front wall of receiver block housing 270, and to a second spring receiving hub 282 on a front wall of spring biased plate 254. Spring biased plate 254 may also have a guide groove 284 on a top side of plate 254, which guide groove 284 may engage a guide fin 286 on the underside of head member 206 (FIG. 15) to maintain alignment of plate 254 as it is pushed by head carrier 250 towards the front end of receiver block housing 270. The underside of head member 206 may have additional guide surfaces 288 on either side of guide fin 286 that engage the top surface of spring biased plate 254 as it moves within receiver block housing 270.

Receiver 252 may be joined to the underside of head member 206 through use of standard threaded members, such as screws or bolts, through flanges 290 on either side of receiver 252 that align with connection hubs 292 on the underside of head member 206.

FIGS. 16, 17, and 18 show top, perspective, and front views, respectively, of head carrier 250 on terminal track segment 202(*g*). Head carrier 250 has an opening 262 in its base, which opening 262 aligns with opening 276 in the bottom of receiver block housing 270 when head carrier 250 is fully inserted into receiver 252. In this position, hook 274 on latch 256 engages head carrier 250, holding it in position until latch 256 is pivoted, after which plate 254 pushes against the front of head carrier 250 so as to cause head member 206 to spring away from head carrier 250.

Figure 19:
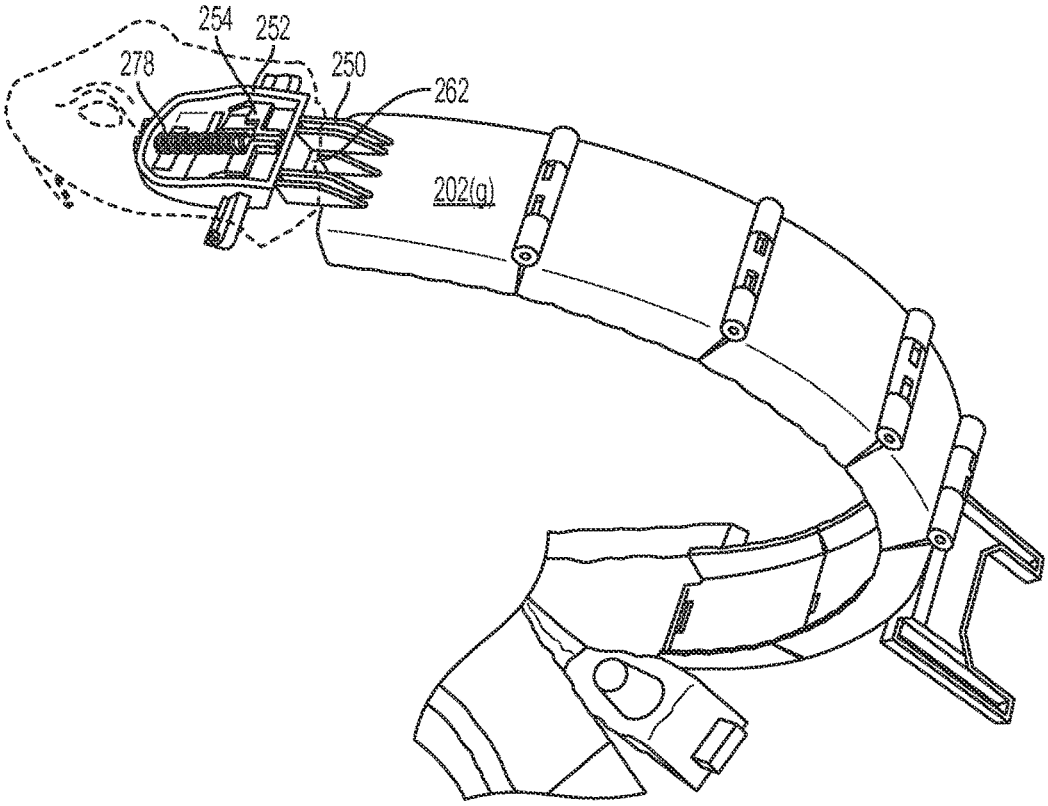
FIG. 19 is a perspective view showing insertion of a head carrier into a receiver block housing.
Figure 20:
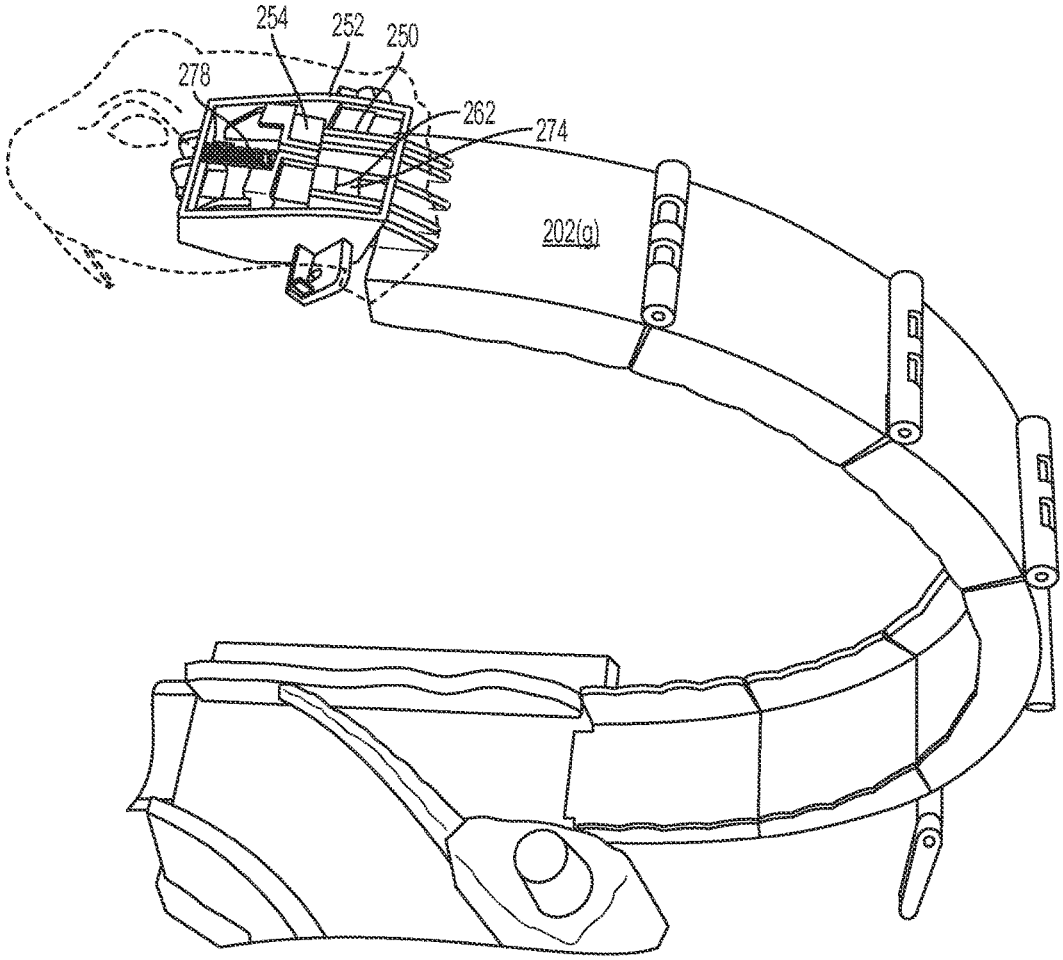
FIG. 20 is a perspective view showing a head carrier fully inserted into a receiver block housing.

FIGS. 19 and 20 show head carrier 250 engaging receiver 252 as head member 206 is moved into its set position (head member 206 being shown in phantom). As shown in the perspective view of FIG. 19, before head carrier 250 is inserted into receiver 252, spring biased plate 254 is biased by spring member 278 toward the back end of receiver 252, such that the forward end of head receiver 250 will come into contact with spring biased plate 254 as head receiver 250 begins to enter receiver 252. Likewise, and as shown in the perspective view of FIG. 20, once head carrier 250 is fully inserted into receiver 252, spring biased plate 254 is pushed toward the front end of receiver 252, compressing spring member 278. Head carrier 250 is in turn held in this set position by upwardly extending hook 274, which extends upward through opening 262 in head carrier 250, until such time as latch 256 is pivoted to remove hook 274 from the path of head carrier 250, thus allowing spring member 278 to rapidly expand and launch head member 206 from terminal track segment 202(*g*).

Moreover, as the center of gravity of partial loop section 200 shifts as a toy vehicle arrives at head member 206, the partial loop section 200 collapses as the head member 206 springs away from the assembly, and drops to the position shown in FIG. 6.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein.

We claim:

1. A toy racetrack comprising:

a collapsible partial loop section comprising a plurality of arcuate track segments provided to form a portion of a loop and a pivotally mounted stand mounted to an underside of at least one of said arcuate track segments, wherein each of said arcuate track segments is hingedly connected to an adjacent arcuate track segment about a horizontal pivot axis, said partial loop section having an unloaded state in which said partial loop section is arranged into a freestanding partial loop and a loaded state in which said freestanding partial loop collapses in response to a toy vehicle applying a force to said freestanding partial loop and causing a shift in the center of gravity of a balancing point of said freestanding partial loop.

2. The toy racetrack of claim 1, further comprising a detachable head mounted to an upper free end of said partial loop section.

3. The toy racetrack of claim 2, wherein said head is spring-biasedly mounted to said upper free end of said partial loop section.

4. The toy racetrack of claim 3, said head further comprising a spring-biased trigger configured to release a compressed spring within said head when said trigger is struck by a toy vehicle exiting said partial loop section.

5. The toy racetrack of claim 1, each one of said arcuate track segment having at least one sidewall extending upward from a side edge of said arcuate track segment.

6. The toy racetrack of claim 5, wherein said arcuate track segments are positionable so as to form a continuous, upwardly curving toy vehicle path in said partial loop section when adjacent wall edges of adjacent track segments are in contact with one another.

7. The toy racetrack of claim 5, wherein the pivotally mounted stand is configured to collapse under the track segments when the freestanding partial loop collapses.

8. The toy racetrack of claim 1, further comprising:

an entrance track section coupled to an entrance of said partial loop section, said entrance track section having a pivotally mounted diverter, a first toy vehicle path configured to direct a toy vehicle toward said collapsible partial loop section, and a second toy vehicle path configured to direct said toy vehicle away from said collapsible partial loop section, wherein said diverter is pivotally mounted between said first and second toy vehicle paths.

9. The toy racetrack of claim 8, further comprising a motor drivingly engaged with said diverter to automatically pivot said diverter.

10. A toy racetrack comprising:

a collapsible partial loop section comprising a plurality of freely pivoting, hingedly attached track segments, a pivotally mounted stand mounted to an underside of at least one of said track segments, and a terminal track segment at an end of said partial loop section, said terminal track segment being positionable to balance said partial loop section so as to maintain a freestanding partial loop when said hingedly attached track segments are positioned into a partial loop;

wherein said collapsible partial loop section has a first position corresponding to said freestanding partial loop and a second position corresponding to a collapsed state caused by a toy vehicle traversing said freestanding partial loop.

11. The toy racetrack of claim 10, further comprising a detachable head mounted to said terminal track segment.

12. The toy racetrack of claim 11, wherein said head is spring-biasedly mounted to said terminal track segment.

13. The toy racetrack of claim 12, said head further comprising a spring-biased trigger configured to release a compressed spring within said head when said trigger is struck by a toy vehicle existing said partial loop section.

14. The toy racetrack of claim 10, each one of said track segment further comprising an arcuate track segment having an arcuate toy vehicle path and at least one sidewall extending upward from a side edge of said toy vehicle path.

15. The toy racetrack of claim 14, wherein said track segments are positionable so as to form a continuous, upwardly curving toy vehicle path in said partial loop section when adjacent wall edges of adjacent track segments are in contact with one another.

16. The toy racetrack of claim 14, wherein said pivotally mounted stand is configured to collapse under said track segments when said freestanding partial loop collapses.

17. The toy racetrack of claim 10, further comprising:

an entrance track section coupled to an entrance of said partial loop section, said entrance track section having a pivotally mounted diverter, a first toy vehicle path configured to direct a toy vehicle toward said collapsible partial loop section, and a second toy vehicle path configured to direct said toy vehicle away from said collapsible partial loop section, wherein said diverter is pivotally mounted between said first and second toy vehicle paths.

18. The toy racetrack of claim 17, further comprising a motor drivingly engaged with said diverter to automatically pivot said diverter.

* * * * *